US005704267A

United States Patent [19]

Merten et al.

[11] Patent Number: 5,704,267

[45] Date of Patent: Jan. 6, 1998

[54] GUIDE SHOE FOR A CUTTING MACHINE ESPECIALLY FOR A DRUM OR DISK SHEARER

[75] Inventors: Gerhard Merten; Frank Fischer, both of Lünen, Germany

[73] Assignee: Deutsche Bergbau-Technik GmbH, Germany

[21] Appl. No.: 592,102

[22] Filed: Jan. 26, 1996

[30] Foreign Application Priority Data

Feb. 25, 1995 [DE] Germany ..... 195 06 676.6
Aug. 29, 1995 [DE] Germany ..... 195 31 729.7

[51] Int. Cl.[6] ..... B26D 5/00

[52] U.S. Cl. ..... 83/823; 104/248

[58] Field of Search ..... 83/823, 485, 614, 83/455, 821; 104/248

[56] References Cited

U.S. PATENT DOCUMENTS

| | | | |
|---|---|---|---|
| 951,698 | 3/1910 | Poole | 104/248 |
| 1,289,653 | 12/1918 | Castano | 104/248 |
| 1,814,969 | 7/1931 | Schmeck | 104/248 |
| 3,080,826 | 3/1963 | Nelson et al. | 104/248 |
| 4,326,440 | 4/1982 | Harmant | 83/488 |
| 4,537,577 | 8/1985 | Sansome et al. | 104/248 |

FOREIGN PATENT DOCUMENTS

| | | |
|---|---|---|
| 2523639 | 3/1982 | France . |
| 2530754 | 1/1977 | Germany . |
| 2552085 | 5/1977 | Germany . |
| 2646291 | 4/1978 | Germany . |
| 2925240 | 1/1981 | Germany . |
| 2938446 | 4/1981 | Germany . |

*Primary Examiner*—Kenneth E. Peterson
*Attorney, Agent, or Firm*—Vickers, Daniels & Young

[57] ABSTRACT

The guide shoe arrangement for disk shearers having a pin wheel gear drive and a coupling sleeve into which engages from above a coupling piece disposed on a positioning arm of the disk shearer, to which a guide shoe is pivotably connected by a gudgeon traversing the coupling sleeve. The height of the guide shoe is considerably less than its length. At the one sidewall of the guide shoe, a guide lug that is preferably formed as a hooked cleat is fixedly disposed. With the guide shoe arrangement it is possible to place the center of gravity of the guide show very low, such as about the guide plane of the guide shoe.

35 Claims, 4 Drawing Sheets

GUIDE SHOE FOR A CUTTING MACHINE ESPECIALLY FOR A DRUM OR DISK SHEARER

GUIDE SHOE FOR A CUTTING MACHINE ESPECIALLY FOR A DRUM OR DISK SHEARER

The invention relates to a guide shoe for a cutting machine, especially for a drum or disk shearer operating above a conveyor and capable of being moved along the conveyor by means of a pin wheel gear drive, with the guide shoe connectable to a positioning arm of the cutting machine by means of a gudgeon, capable of being swivelled upwards or downwards and possessing a guide lug bearing from below on a guide rail at the conveyor.

BACKGROUND OF THE INVENTION

Cutting machines like drum shearers or disk shearers are, as is well-known, used in mining firms worldwide for working coal seams. They are deployed in underground working in conjunction with a conveyor in the form of a drag link conveyor capable of advancing in direction of the coal face, and they are so constructed as to over-arch the conveyor with their machine frame in the way of a portal. With this, the disk shearers are supported and guided on both sides of the conveyor on guide rails disposed on the conveyor.

Contemporary cutting machines of this kind are moved along the conveyor during their winning travel by means of a pin wheel gear drive. With this it is usual to arrange a pin wheel gear element consisting of racks or pin wheel pinions or preferably of a pin wheel chain at the side facing away from the coal face, i.e. on the stowage side of the conveyor. The shearer in this case possesses at least one gearwheel respectively cylindrical lantern gear driven by the drive and which engages the pin wheel pinion running in bearings at the conveyor, respectively the horizontal chain links of the pin wheel (DE-PS 25 30 754, DE-OS 29 38 446, FR-PS 2 523 639).

It is common usage to guide the shearer along guide rails, in this case attached laterally to the conveyor, by means of guide shoes on that side (generally the stowage side) of the conveyor where the pin wheel gear element respectively the pin wheel chain is situated, with control of the machine being effected in both elevation and lateral direction by means of the guide shoes. It is furthermore also known how to link the guide shoes to the shearer respectively to the positioning arms of the latter by means of horizontal gudgeons affording them a limited capacity for swivelling horizontally, so that they can adjust to the mostly non-rectilinear course of the conveyor. In this case one employs, for example, guide shoes that grip around the pin wheel pinions as if hook-like from above and below and which are pivotably connected to the shearer respectively its machine frame at a distance above the pin wheel pinions by means of the horizontal gudgeons (DE-PS 25 52 085, DE-PS 26 46 291, DE-OS 29 25 240). But it is also known to attach supporting rails to the conveyor at the stowage side, within which is disposed the pin wheel chain and which at the same time form guide rails for the guide shoes (FR-PS 2 523 639). With all these arrangements, the gudgeon serving the articulated connection of the guide shoes is situated at a distance above the pin wheel pinions respectively the pin wheel chain so that the pivoting point of the guide shoes is disposed at a relatively great vertical distance from the guide plane.

SUMMARY OF THE INVENTION

Departing from the above-mentioned state of the art—which is at the same time subsumed in the disclosure content of the description of the present invention—the invention is predominantly based on the task of creating a guide shoe for cutting machines which is distinguished by a high constructive strength and reliable articulated connectivity at the positioning arm of the shearer and which offers the possibility of placing the articulated joint relatively low in relation to the plane of the pin wheel gear element—which is preferably in the form of pin wheel chain—preferably about at the level of the guide plane of the guide shoe at the guide bead respectively guide rail attached to the conveyor, which is advantageous, above all, with a view to good vertical and horizontal guidance of the shearer and the transmission of the positioning forces.

This task is solved according to the invention by the guide shoe possessing mortise type pocket or a coupling sleeve that is open on its upper side for engaging a coupling piece of the positioning arm and is bounded by wall parts at its longitudinal, frontal as well as bottom sides; and by the lateral walls of the guide shoe being provided with aligned bolt holes for the gudgeon which penetrates a bolt hole of the coupling piece within the coupling sleeve, with the guide lug being rigidly disposed externally at the respective sidewall of the guide shoe and with the height of the guide shoe being less than its length.

With this embodiment of the guide shoe having a coupling sleeve as a mortise type pocket serving to engage a coupling piece that is bounded by wall parts along its periphery and bottom there results a good fit and reliable swivelling displacement of the guide shoe at the positioning arm of the disk shearer, whereby at the same time the articulated bolt joint can be arranged in a low position, namely below the bearing plane of the pin wheel chain or similar and at least approximately in the plane of the guide rail at which the shearer guides itself by means of the guiding shoes. Thus there results a proper and reliable guidance of the disk shearer in the coal cutting operation by means of the guide shoes attached to it. In this respect it is advantageous for the guide shoe according to the invention to possess a relatively low overall height. Preferably, its overall height will not be greater than about three times the diameter of the gudgeon respectively of the bolt holes accommodating the gudgeon.

In a further advantageous embodiment of the invention, the guide shoe possesses at its bottom, preferably in the center of the bottom, a bottom opening for engagement of the coupling piece. With this the bolt holes are suitably disposed at the lateral walls of the guide shoe in the region of the bottom opening in such a way that they lie in the plane of the bottom opening with at least their lower hole area. This arrangement contributes to placing the articulated connection respectively the gudgeon even lower. The coupling piece is advantageously given a convex arch-like shape that penetrates the bottom opening in the coupling state.

In order to prevent dirt, such as for example nutty slack, from accumulating in the coupling sleeve and from blocking the unrestricted swivelling capability of the guide shoe, the guide shoe is advantageously equipped with dirt egress openings at the frontal walls, which suitably extend across essentially the entire inner width of the coupling sleeve and which are bounded at their lower side by the upper surface of the bottom.

In a further advantageous embodiment of the invention, the interior surfaces of the parallel sidewalls of the guide shoe are formed as vertically oriented, level bearing surfaces for the plate-shaped coupling piece. The breadth of the coupling sleeve in this case is closely adapted to the thickness of the plate-shaped coupling piece, so that the coupling piece essentially fills the coupling sleeve while still allowing for the play required for the swivelling movement of the articulation, and so that there results good lateral support for the guide shoe at the coupling piece and thus at the positioning arm of cutting machine.

The guide shoe is articulated at the positioning arm and capable of pivoting, within limits, by means of the gudgeon. To limit the swivelling range of the guide shoe, its bottom may be inclined towards the two opposite sides of the guide shoe, i.e. made to slope obliquely, with these oblique surfaces forming stop surfaces which co-operate with opposing stop surfaces disposed at the coupling piece on both sides of the gudgeon so as to limit the pivoting capability. On the other hand, this limitation of pivoting capability may also be effected by way of stopping the coupling piece or its positioning arm on the upper side of the guide shoe.

The guide lug disposed externally at the lateral wall of the guide shoe is suitably formed as a hooked cleat and provided with an jutting guide hook. Besides, it is recommended to provide at least one dirt egress opening at the guide lug respectively the hooked cleat and which opens both upwards and downwards, so that any occurring dirt can run off the hooked cleat via the dirt egress opening. Further, the arrangement is advantageously so made that the guide shoe is connected to the positioning arm of the shearer by means of the gudgeon below the bearing position of the pin wheel gear element consisting of a pin wheel chain.

With the guide shoe according to the invention, the guide channel formed between the guide hook and the inner sidewall of the guide shoe and which serves for the engagement of the guide lug may be so shaped that it increases in width from its central region toward its two ends. In one appropriate form of embodiment the guide hook possesses, in the central area between its two ends, a frontal surface extending horizontally, followed by frontal surfaces of the guide hook that slope away towards the two ends of the guide hook. In this way one ensures that the guide shoe in actual operation guides itself along the fixed guide rail essentially only by way of the central area of its guide hook but not with the sloped frontal surfaces disposed on either side of this central area.

It goes without saying that the guidance of the guide shoe at the guide rail is so executed that proper machine guidance is ensured even when the guide rail fixed to the conveyor does not run straight but, as is usually the case, takes a course that is curved in the plane of the base of the seam and also in the plane that is perpendicular to it. While guidance in the above-mentioned vertical plane is achieved by the articulated connection of the guide shoe with the disk shearer, the lateral guidance in the plane of the base of the seam can be achieved by an appropriate guide play between guide rail and guide hook of the guide shoe. In this context it is advantageous for a guide piece that is shaped like a circle segment capable of limited swivelling movement in the horizontal plane to run in bearings within an approximately circle segment-shaped bearing recess in the central area of the surface of the inner lateral wall of the guide shoe facing the guide hook, the—preferably vertical—guiding surface of which projects beyond the external surface of the inner sidewall into the guide channel when in the middle pivoting position and which thus guides itself along the guide rail engaging in the guide channel, whereby exact guidance of the guide shoe is ensured also in the lateral direction. The circle segment-shaped guide piece, being an expendable part, is easily replaced. It is suitably removably disposed at the inner sidewall of the guide shoe by means of a securing element such as a locking pin, a split taper sleeve or the like, whereat the securing element may be so disposed in a vertical drill hole of the inner sidewall of the guide shoe that it runs through a hole of the circle-segment shaped guide piece with the clearance required for its pivoting movement. This hole in the guide piece is suitably executed as an axial elongated hole.

The guide shoe according to the invention is formed in one piece and suitably made symmetrical in relation to its vertical central longitudinal plane. It may be produced as a one-piece casting or forging.

In summary, the present invention pertains to a guide shoe for a cutting machine, especially for a drum or disk shearer operating above a conveyor and capable of being moved along the conveyor by means of a pin wheel gear drive, with the guide shoe connectable to a positioning arm of the cutting machine and capable of being swivelled upwards or downwards by means of a gudgeon and possessing a guide lug bearing from below on a guide rail at the conveyor. The guide shoe possesses a coupling sleeve in form of a mortise type pocket that is open at the upper side for engagement by a coupling piece of the positioning arm and is bounded at its lateral and front sides as well as at the bottom side by wall parts, and in that the sidewalls of the guide shoe are equipped with aligned bolt holes for the gudgeon which traverses a bolt hole of the coupling piece within the coupling sleeve, with the guide lug being fixedly disposed externally on the inner sidewall of the guide shoe and that the height of the guide shoe is less than its length. Preferably the height of the guide shoe is no larger than about three times the diameter of the gudgeon. The guide shoe may also possess a bottom opening in its bottom, preferably centrally, for engagement of the coupling piece. The bolt holes of the guide shoe are preferably arranged in the sidewalls in the area of the bottom opening of the guide shoe so that the bolt holes lie in the plane of the bottom opening with at least their lower hole area. The coupling piece preferably has a convex arch-shaped deformation that penetrates the bottom opening when in the coupling position. The guide preferably includes dirt egress openings at the front walls. The dirt egress openings preferably extend essentially across the interior width of the coupling sleeve and are preferably bounded at their lower side by the upper side of the bottom. The shoe guide is preferably designed to include parallel side walls having inner surfaces which form vertically oriented level stop surfaces for the plate-shaped coupling piece. The positioning arm and has limited swivelling capability. The guide shoe is preferably designed to that the guide lug disposed externally at the sidewall is preferably formed as a hooked cleat with jutting guide hook. The guide lug, respectively the hooked cleat forming it, is preferably equipped with at least one dirt egress opening that opens upwards and downwards. The dirt egress opening is preferably shaped symmetrically in relation to its vertical central plane. The guide shoe is preferably connected to the positioning arm of the disk shearer by means of a gudgeon below the bearing position of the pin wheel gear element consisting of a pin wheel gear chain. The guide shoe is designed to preferably consist of a one-piece casting or forging. The guide shoe is also preferably designed so that the guide channel, formed between the guide hook and the inner sidewall of the guide shoe and which serves for engaging the guide rail, expands in width from its central area towards its two ends. Preferably, the guide hook possesses a horizontal frontal surface in the central area between its front surfaces sloping towards the two ends of the guide hook. Furthermore, the sidewalls of the guide hook are preferably inclined downward, diverging from each other in the central area of the former, with at least the inner side surface that is inclined at an acute angle to the vertical plane being shaped so as to run obliquely to the outside towards the two ends of the guide hook in a lengthwise direction from the said central area. The guide hook outer surface of the inner sidewall and which faces the guide hook is also preferably arranged in its central area so as to be vertically oriented and parallel to the longitudinal axis of this sidewall, and that it is so arranged that it runs obliquely, with vertical surfaces, from this central area towards the ends of the guide channel amid widening of the guide channel. The guide shoe is preferably includes a circle segment-shaped guide piece capable of limited swivelling in the horizontal plane runs in bearings in a circle segment-shaped bearing recess in the surface of the inner sidewall facing the guide hook in its central area, the preferably vertically-oriented guiding surface of which protrudes beyond the outer surface of the inner sidewall into the guide channel when in the middle swivelling position. The circle segment-shaped guide piece is preferably secured by means of a safety element in the shape of a pin, a split taper sleeve or the like that is disposed within a vertical drill hole in the inner sidewall of the guide shoe and which traverses, with play, a hole in the guide piece that is preferably formed as an axial elongated hole. The guide shoe is also preferably designed to that the gudgeon possesses, at the bolt end located in the drill hole at the outer sidewall of the guide shoe, a circumferential safety groove for the engagement of a safety element in the form of a safety screw, a securing pin or the like that is removeably disposed in a vertical drill hole in this sidewall. The gudgeon also preferably possesses an axial internal thread at its outer end, said thread being open toward this bolt end. Furthermore, the bolt hole accommodating the gudgeon and which is situated in the inner sidewall on the side of the guide lug is preferably formed as a blind hole.

BRIEF DESCRIPTION OF THE DRAWINGS

Reference may now be made to the drawings, which illustrate various embodiments that the invention may take in physical form and in certain parts and arrangements of parts wherein.

FIG. 9 is a guide shoe corresponding in design to the guide shoe according to FIGS. 6 to 8, but with associated pivotable guide piece, in plan view, partially opened, with the guide rail that operates in conjunction with the guide shoe being hinted at;

DETAILED DESCRIPTION OF THE PREFERRED EMBODIMENTS

Figure 1:
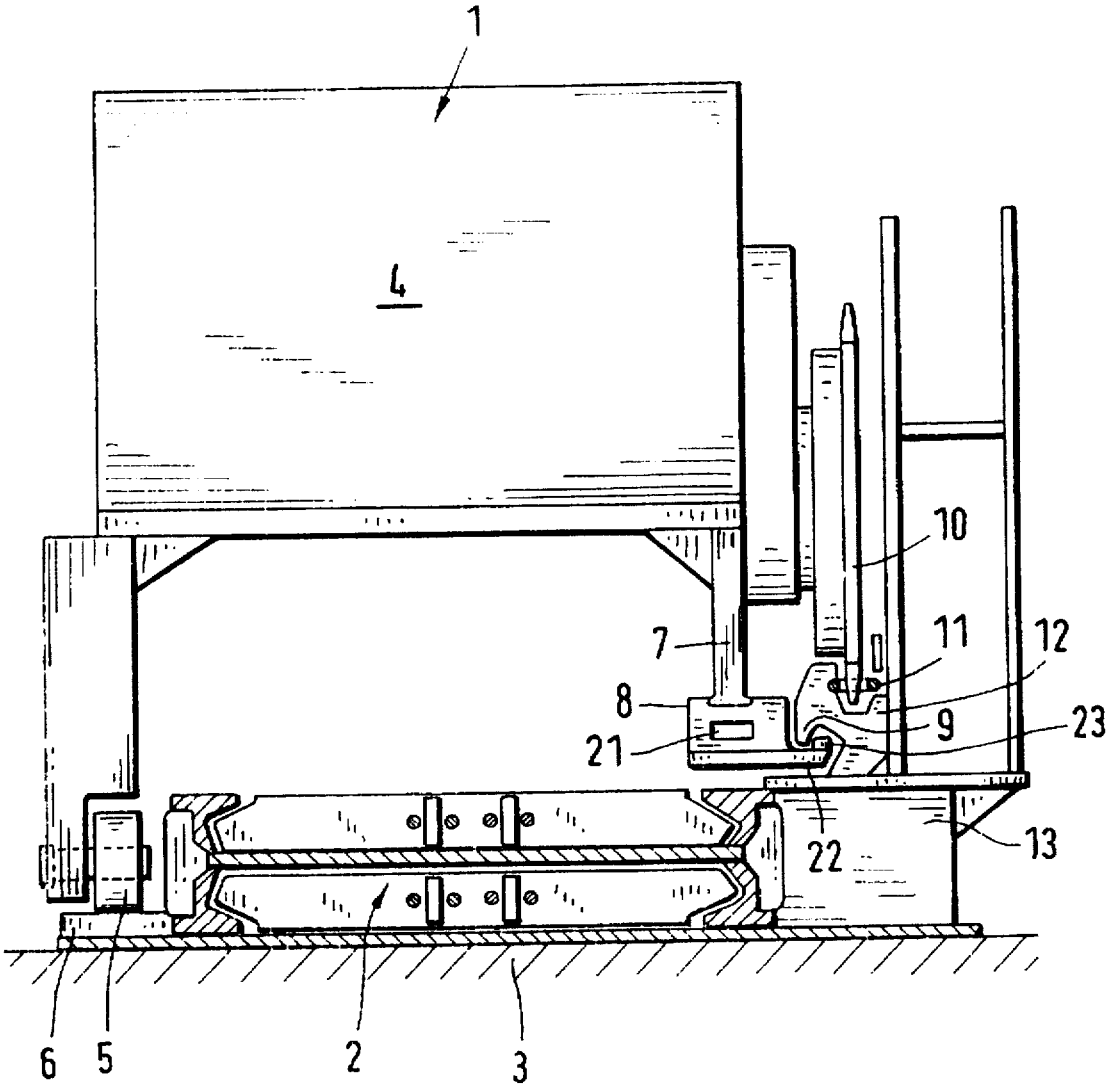
FIG. 1 is a schematically simplified view, in the lengthwise direction, of the conveyor of an otherwise known disk shearer with its guiding system and with pin wheel gear drive, with the conveyor being shown in vertical section.

Referring now to the drawings, wherein the showings are for the purpose of illustrating the preferred embodiments of the invention only and not for the purpose of limiting the same, FIG. 1 shows, in a highly diagrammatic general plan, an otherwise known coal cutting plant with a disk shearer 1 and a conveyor 2, which is disposed within the underground working operation on the base of a seam 3 ahead of the coal face (not shown). Essentially, the only portion of the disk shearer shown is its machine frame 4, which over-arches the conveyor 2 in the manner of a gantry and which is supported on the one side of the conveyor (the coal face side) by means of rollers 5 or also runners on a roller rail 6 that is fixedly disposed at the side of the conveyor 2. At the opposite side (stowage side), the machine frame 4 possesses one positioning arm 7 on each of its two ends, at the lower end of which a guide shoe 8 is pivotably attached and which guides itself along a guide rail 9. The disk shearer 1 possesses a travelling mechanism with at least one driven gearwheel respectively cylindrical lantern gear 10 which meshes with a pin wheel gear chain 11 that runs in bearings on a supporting rail 12. In the example of embodiment shown the supporting rail 12 at the same time forms the guide rail 9. It is rigidly arranged on cantilever girders 13 that are built on to the conveyor 2 at the stowage side.

The conveyor 2 customarily consists of a drag link conveyor, the hauling train of which is made up from individual scraping troughs that are so linked as to afford them a small degree of vertical and horizontal articulation.

Disk shearer plants of the design described above or of similar construction are known in numerous designs and have been in use for many years. Essential to the invention is the design and arrangement of the guide shoes 8 of the disk shearer.

As depicted mainly in FIGS. 2 to 5, the one-piece guide shoe 8 possesses an approximately slot-like coupling sleeve 14 which opens on the upper side of the guide shoe 8 for the engagement of a plate-shaped coupling piece 15 that is fixedly disposed at the lower end of the positioning arm 7.

Figure 2:
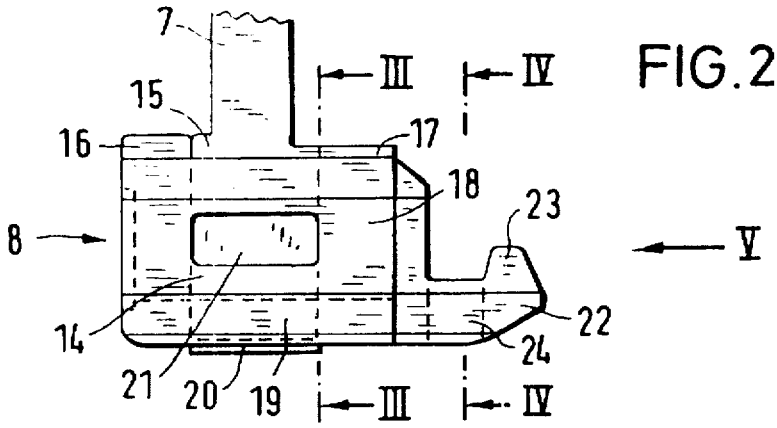
FIG. 2 is a guide shoe according to the invention in a frontal view corresponding to FIG. 1.

The coupling sleeve 14 is bounded at its two long sides by sidewalls 16 and 17 of the guide shoe that run parallel to each other, and at the two opposite narrow frontal sides of the guide shoe 8 by front walls 18 as well as at its bottom side by a bottom 19 which possesses a bottom opening 20 at its center. At its two front walls 18 the guide shoe 8 possesses one dirt egress opening 21 each, by way of which any dirt that may reach the coupling sleeve, such as particularly nutty slack, can exit from the coupling sleeve to the outside. As shown in FIG. 2 the dirt egress openings 21 each have an about rectangular outline. They extend essentially across the inner width of the coupling sleeve 14 between the sidewalls 16 and 17 and are bounded at their lower side by the upper side of the bottom 19 (FIG. 3).

Figure 3:
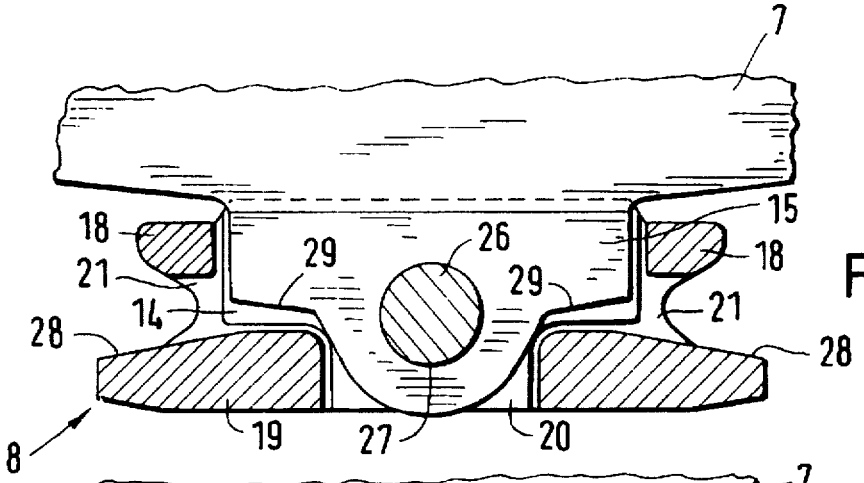
FIG. 3 is a vertical longitudinal section of the guide shoe along the line III—III of FIG. 2.
Figure 4:
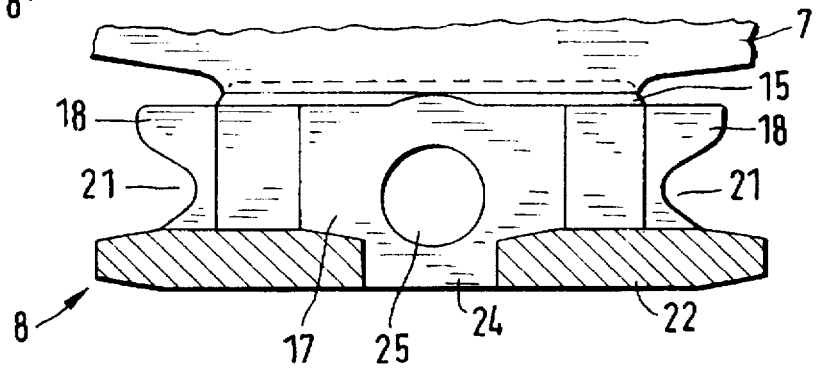
FIG. 4 is a vertical longitudinal section of the guide lug of the guide shoe along the line IV—IV of FIG. 2.
Figure 5:
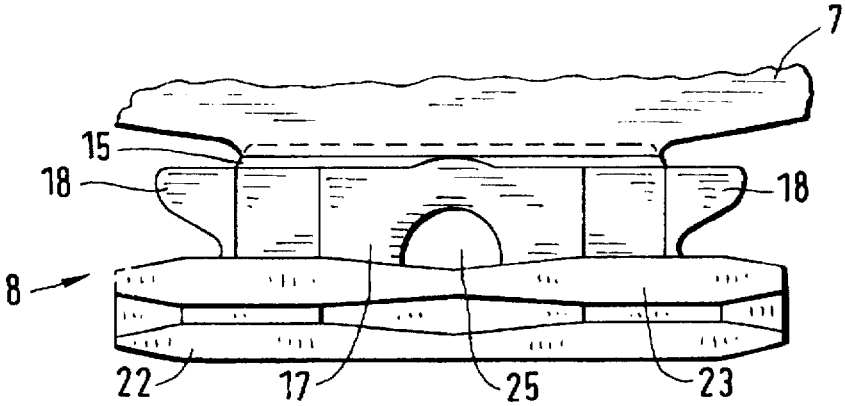
FIG. 5 illustrates guide shoe according to FIGS. 2 to 4 in a view in the direction of the arrow V of FIG. 2.

The guide shoe 8, as shown in FIGS. 3 to 5, is so made as to be symmetrical about its vertical central plane. At the inward-lying sidewall 17 a solid guide lug 22 is disposed externally at the level of the bottom 19 and which, as shown in particular in FIGS. 2 and 5, extends across the entire length of the guide shoe 8 and is formed as a hooked cleat that is equipped with a jutting guide hook 23. As FIG. 1 shows, the hooked cleat 22 reaches around the guide rail 9 that is fixedly attached to the conveyor from below, with the guide hook 23 gripping the guide rail 9 from behind in a slotted recess, so that the disk shearer 1 is guided along the guide rail 9 in the horizontal and vertical direction by means of the guide shoe 8. As per FIG. 4, the guide lug respectively hooked cleat 22 that forms it possesses a dirt egress opening 24 in its center that is open both upward and downward so that dirt respectively nutty slack entering on to or into the hooked cleat can run off downward from the hooked cleat.

The parallel sidewalls 16 and 17 of the guide shoe 8 each possess in its center aligned bolt holes 25, into which can be inserted a horizontal gudgeon 26, the axis of which runs crosswise to the longitudinal direction of the conveyor 2 and thus crosswise to the direction of travel of the disk shearer 1. The gudgeon 26 inserted into the aligned bolt holes 25 traverses a bolt hole 27 of the coupling piece 15 within the coupling sleeve 14, whereby the guide shoe 8 is held at the coupling piece 15 and thus at the positioning arm 7 while being capable to be vertically pivoted in a limited way about the gudgeon 26. FIG. 3 permits to discern that the coupling piece 15 is provided in its central area, where the bolt hole 27 is located, with a convex arch-shaped projection respectively portion reaching into the bottom opening 20, and that the bolt holes 25 and 27 are so disposed at the sidewalls 16 and 17 respectively the coupling piece 15 that they lie in the plane of the bottom opening 20 with at least their lower hole diameter. This arrangement makes it possible to place the gudgeon 26 and thus the pivot point of the guide shoe relatively low at the coupling piece 15, namely at about the level of the upper edge of the guide hook 23.

One can see from FIGS. 3 to 5 that the length of the guide shoe 8 is considerably greater than its height. The height of the guide shoe 8 is markedly smaller than three times the diameter of the gudgeon 26; in accordance with FIG. 3 it is about equal to twice the diameter of the gudgeon 26.

FIG. 2, in particular, shows that the inner surfaces of the two parallel sidewalls 16 and 17 of the guide shoe 8 are formed as vertically-oriented level surfaces that form stop surfaces for the plate-shaped coupling piece 15, the lateral surfaces of which that are facing the inner surfaces of the sidewalls 16 and 17 are equally formed as level vertical surfaces. The width of the coupling piece 15 in this case essentially corresponds to the inner width of the coupling sleeve between the inner surfaces of the sidewalls 16 and 17.

As shown in FIG. 3, the bottom 19 of the guide shoe 8 is so shaped that it slopes downward at its upper side toward the two opposite ends of the guide shoe, thus forming inclined stop surfaces 28 that bound the dirt egress openings 21 at the bottom side. The coupling piece possesses—at either side of its bulge-shaped central portion with the bolt hole 27—counterpart stop surfaces 29 that slope upward, whereby a limitation of pivoting movement is effected. One can see that when the guide shoe 8 is swivelled about the gudgeon 26 in the one or other pivoting direction the stop surface 28 in question runs up against the associated counterpart stop surface 29 of the coupling piece 15, whereby the limitation of pivoting is effected.

The counterpart stop surfaces 29 may however be omitted. In this case, the arch-shaped section of the coupling piece 15 may be continued obliquely upward on either side of the gudgeon 26 up to the positioning arm 7, so that the coupling piece is given an approximately triangular shape in the view of FIG. 3 and the limitation of pivoting is effected by the upper transitional area of the coupling piece 15 toward the positioning arm contacting the upper surface of the sidewall or sidewalls of the guide shoe.

The guide shoe described above may be produced as a one-piece casting or forging. As shown in FIG. 1, it is attached to the positioning arm 7 of the disk shearer 1 by means of the gudgeon 26 below the bearing position of the pin wheel gear element, here consisting of a pin wheel gear chain 11. The center of gravity of the guide shoe thus lies below the bearing level of the pin wheel gear chain 11 and in the immediate area of the level of the guide rail 9; along which the guide shoe guides itself. It is obvious that the gudgeon 26 is secured, in the insertion position, against coming loose, something which can be achieved by means of customary gudgeon safety devices. Furthermore, the low-profile guide shoe is easily removed from the positioning arm respectively the latter's coupling piece 15, and if necessary replaced, by withdrawing the gudgeon. FIG. 2 shows that the outer sidewall 16 extends a little higher than the inner sidewall 17 of the guide shoe, and that the plate-shaped coupling piece 15 is of a width corresponding to that of the inner width of the coupling sleeve 14 and somewhat larger than that of the positioning arm 7.

Figure 6:
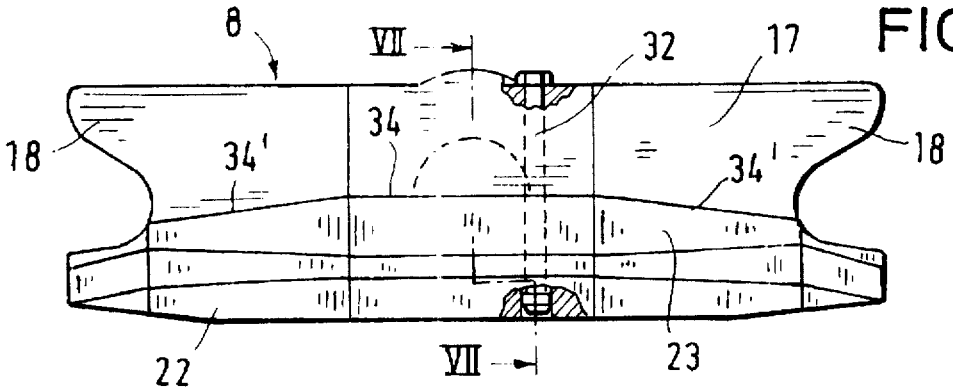
FIG. 6 is an embodiment of a guide shoe according to the invention that has been changed in some details; in a view corresponding to that of FIG. 5, partially opened and without associated coupling piece.
Figure 7:
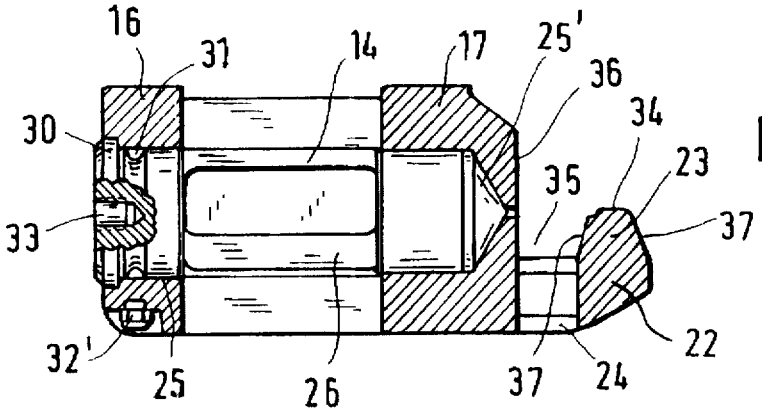
FIG. 7 illustrates guide shoe in cross-section along line VII—VII of FIG. 6.
Figure 8:
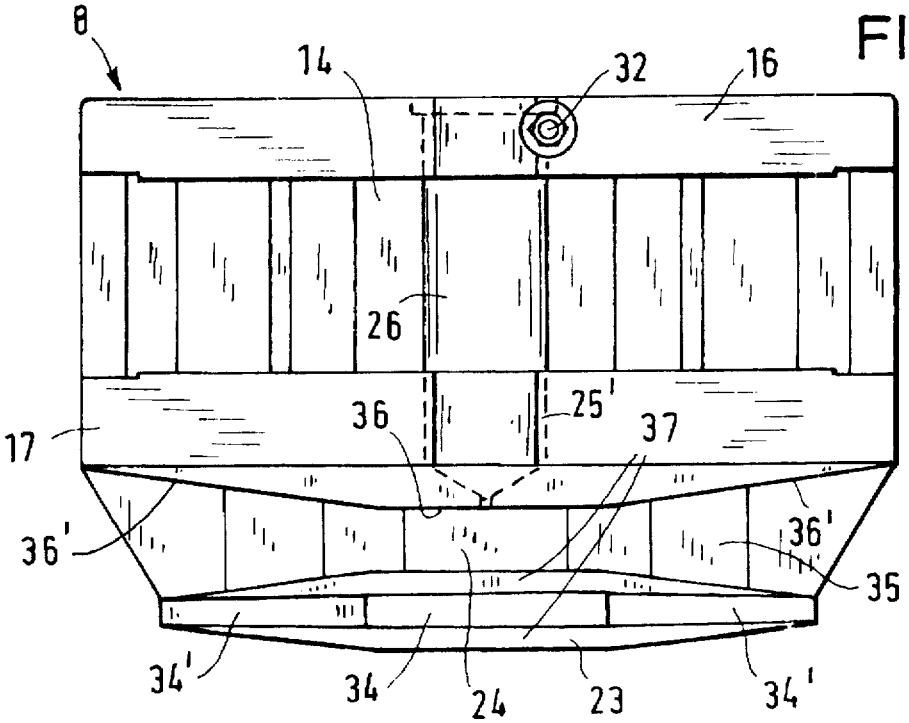
FIG. 8 illustrates guide shoe according to FIGS. 6 and 7 in plan view.

FIGS. 6 to 8 show a guide shoe that corresponds, in its basic construction, to that of FIGS. 2 to 5, but which is altered in certain individual elements. One can see that the bolt hole on the interior sidewall 17 of the guide shoe 8—serving for insertion of the gudgeon 26 and here designated 25'—is formed as a blind drill hole into which the gudgeon 26 penetrates with its end, without traversing the full thickness of the sidewall 17. One can further observe that the gudgeon 26 possesses a bolt head 30 of larger diameter at its end situated on the side of the outer sidewall 16, and laterally adjacent a circumferential annular safety groove 31, into which penetrates tangentially a safety screw 32 that is inserted into a vertical drill hole in sidewall 16 and on to the lower end thread of which is firmly screwed a nut 32' that is counter-sunk into a recess at the lower side of the sidewall 16. In this manner the gudgeon 26 is secured in its fitting position. In addition, FIG. 7 shows that an axial thread 33 has been tapped centrally into the bolt head, into which a threaded extractor device can be screwed in order to withdraw the gudgeon 26 from the bolt holes of the sidewalls 16 and 17, after loosening the safety screw 32.

One can further see from FIGS. 6 to 8 that the upper frontal surface of the guide hook 23 is formed, in its central area, by a level horizontal surface 34 which as per FIGS. 6 and 8 extends approximately across a third of the length of the guide lug 22 and which is bounded at either side by frontal surfaces 34' that slope away obliquely from the plane of the frontal surface 34 towards the two ends of the guide hook 23.

The guide channel 35 formed between the guide hook 23 and the inner sidewall 17 of the guide shoe 8 and which serves to engage the hook-shaped guide rail projection 9 is, as can be observed from FIG. 8, so formed as to conically expand in width from the central area of the guide cleat 22—the length of which is essentially defined by the length of the frontal surface 34—in direction of the two ends of the guide rail. With this, the outer surface of the interior sidewall 17 facing the guide hook 23 is formed—in the central area of the guide channel 35 and thus essentially over the length of the support surface 34—as a vertical guide surface 36 running parallel to the longitudinal axis of the guide hook 23 that is followed by vertical lateral surfaces 36' running at an inwardly acute angle toward the two ends of the interior sidewall 17. Furthermore the lateral surfaces 37 of the guide hook 23 are set out, in the said central area of the latter, sloping downward at a diverging angle vis-à-vis each other, whereat they are formed, along the two portions between the central area and the ends of the guide hook 23 so as to run outward obliquely in a lengthwise direction amid a widening of the guide channel 35. These characteristics shown in FIGS. 6 to 8 result in a reliable guidance of the guide shoe 8 at the hook-shaped guide rail 9 also in a lateral direction when this guide rail 9 does not take a straight course. This is also apparent from FIG. 9, where the guide rail 9 that engages in the guide channel 35 is indicated schematically.

Figure 9:
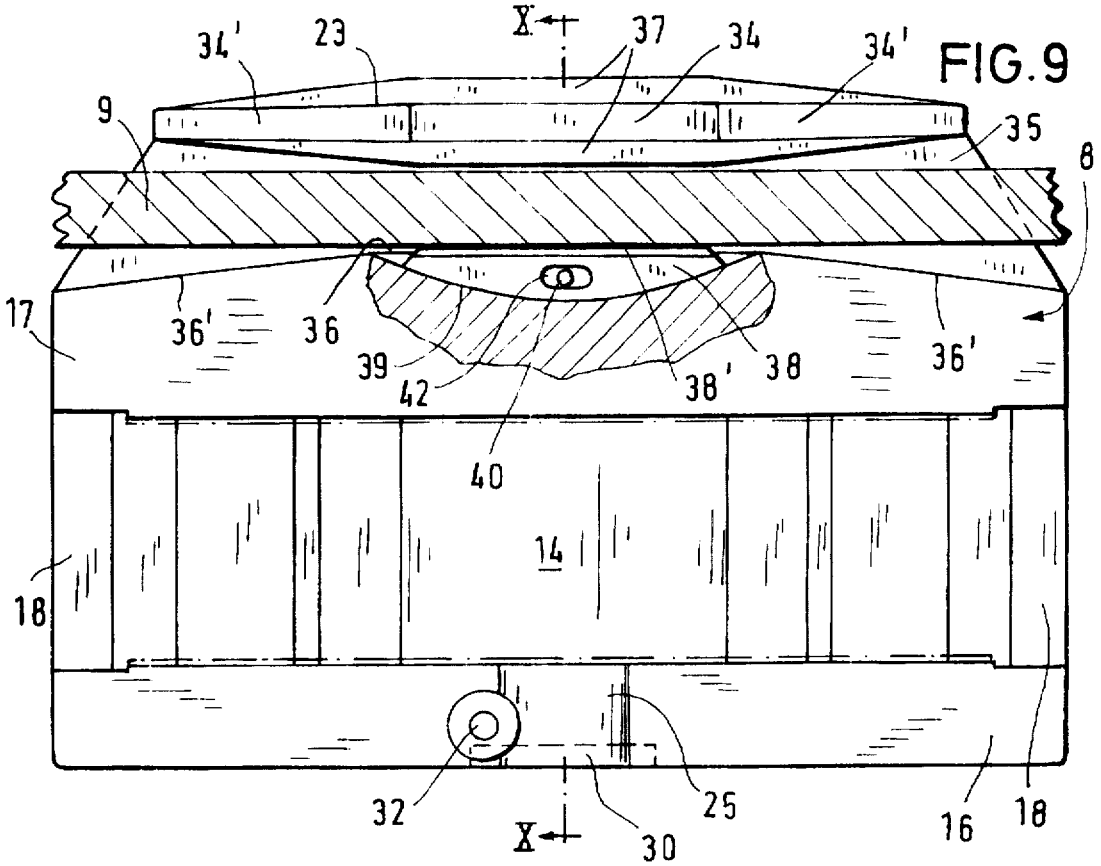
Figure 10:
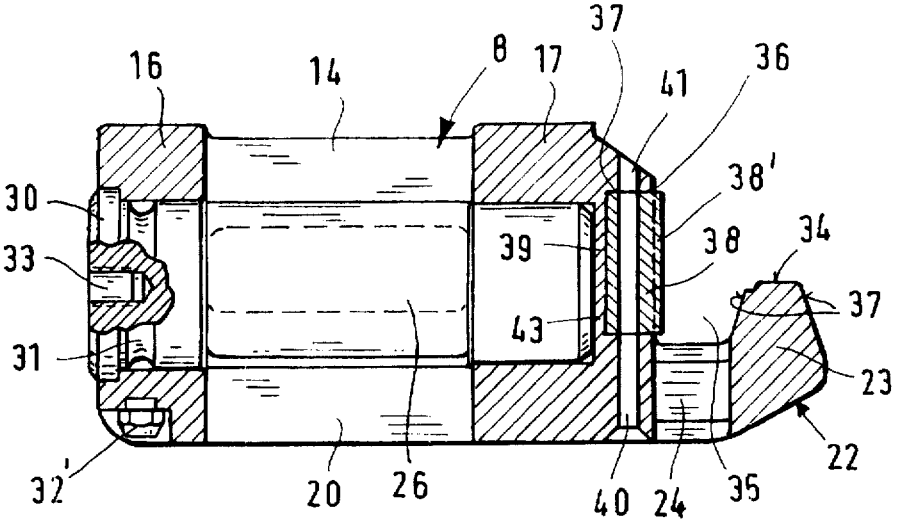
FIG. 10 is a section along line X—X of FIG. 9.

The example of embodiment according to FIGS. 9 and 10 is distinguished from that of the FIGS. 6 to 8 essentially in that at the vertically-oriented central wall section 36 of the internal sidewall 17, a circle segment-shaped guide piece 38 runs in bearings and is capable of limited swivel in the horizontal plane within a corresponding circle segment-shaped bearing recess 39 of the sidewall 17, the upright guide surface 38' of which protrudes marginally beyond the outer surface 36 in the central position shown and forms a vertical guiding surface for the guide rail 9. The circle segment-shaped guide piece 38 is capable of limited swivel about a vertical axis within the bearing recess 39, namely to an angle of for example 2° to 3° in either direction from the middle position shown in FIG. 9. It is secured at the sidewall 17 by means of a safety element 40 in the shape of a dowel pin or safety bush. The safety element 40 is inserted into a vertical drill hole 41 of the sidewall 17 and traverses, with some play, an axial elongated hole 42 in the center of the circle segment-shaped guide piece 38, so that this latter can carry out, apart from the said swivelling movement, minor movements in the direction of the longer axis of the elongated hole 42 in order to adapt to the relative position between guide shoe 8 and guide rail 9. Besides, the circle segment-shaped guide piece 38, being an expendable part, can easily be replaced. As shown in FIG. 10 the circle segment-shaped bearing recess 39 is so disposed in the sidewall 17 that there remains a small partition 43 in the sidewall 17 between the curved bottom of this bearing recess 39 and the blind bore 25'.

The invention has been described with reference to a preferred embodiment and alternates thereof. It is believed that many modifications and alterations to the embodiments disclosed will readily suggest themselves to those skilled in the art upon reading and understanding the detailed description of the invention. It is intended to include all such modifications and alterations insofar as they come within the scope of the present invention.

We claim:

1. A cutting device having a guide shoe arrangement for guiding said cutting device along a guide rail, said guide shoe arrangement including a guide shoe, a positioning arm and a guide shoe connector, said guide shoe having a front wall which faces said guide rail, a rear wall, a top side, a bottom side and two side walls, a guide lug and a coupling sleeve, said positioning arm being connected to said cutting device, said guide lug projecting from said front wall in a direction away from said rear wall, said guide lug having a guide hook, wherein a space between said guide hook and said front wall of said guide shoe defines a channel which engages said guide rail, said guide shoe connector rotatably connecting said positioning arm to said coupling sleeve, said coupling sleeve being at least partially positioned at said top side of said guide shoe and including a back side, a front side and two lateral sides, said back and front sides including aligned bolt holes, said positioning arm including a bolt hole which is aligned with said bolt holes in said back side and said front side of said coupling sleeve, said guide shoe connector including a bolt inserted in said bolt hole of said positioning arm and said bolt holes of said back side and said front side of said coupling sleeve.

2. A cutting device as defined in claim 1, wherein said coupling sleeve at partially positioned in the interior of said guide shoe and having an opening in said top side of said guide shoe, said coupling sleeve having a mortise type pocket adapted to telescopically receive at least a portion of said positioning arm.

3. A cutting device as defined in claim 2, wherein said bottom side of said coupling sleeve adapted to receive a portion of said positioning arm, said bottom side of said coupling sleeve extending through said bottom side of said guide shoe.

4. A cutting device as defined in claim 3, wherein said positioning arm includes a convex arch-shaped portion that is receivable by said bottom side of said coupling device.

5. A cutting device as defined in claim 4, including at least one dirt egress opening.

6. A cutting device as defined in claim 5, wherein said at least one dirt egress opening traversing said side walls of said guide shoe.

7. A cutting device as defined in claim 6, wherein said guide lug includes at least one dirt egress opening through said guide lug in a plane substantially parallel to said front wall of said guide shoe.

8. A cutting device as defined in claim 6, wherein said channel including two channel ends and a mid-channel position formed generally between said two channel ends, and at least one channel end having a width which is greater than the width of said mid-channel position.

9. A cutting device as defined in claim 6, wherein said guide hook includes a front face, said front face including two side sections and a central section and at least one of said side sections sloping inwardly from said central section.

10. A cutting device as defined in claim 6, wherein said guide hook includes an inner face, said inner face including two side sections and a central section, and at least one of said side sections sloping inwardly from said central section.

11. A cutting device as defined in claim 6, wherein said guide hook includes a top face, said top face including two side sections and a central section, and at least one of said side sections sloping downwardly from said central section.

12. A cutting device as defined in claim 6, wherein said guide lug is rotatably connected to said front wall of said guide shoe.

13. A cutting device as defined in claim 12, wherein said guide lug is secured in a sleeve of said front wall by a pin.

14. A cutting device as defined in claim 1, wherein said sides of said coupling sleeve limits said rotational movement of said guide shoe.

15. A cutting device as defined in claim 14, wherein said coupling sleeve limits rotation of said guide shoe about a longitudinal axis of said positional arm.

16. A cutting device as defined in claim 15, wherein said coupling sleeve substantially prevents rotation of said guide shoe about said longitudinal axis of said position arm and limits rotation of said guide shoe on an axis substantially transverse to said longitudinal axis of said positioning arm.

17. A cutting device as defined in claim 1, wherein said positioning arm is laterally spaced from said guide rail longitudinal axis.

18. A cutting device as defined in claim 1, said guide shoe includes a height and a width, said height equal to a distance between said top side and said bottom side, said width equal to a distance between said side walls, said width at least about three times greater than said height.

19. A cutting device as defined in claim 1, wherein said guide lug includes at least one dirt egress opening through said guide lug in a plane substantially parallel to said from wall of said guide shoe.

20. A cutting device as defined in claim 1, wherein said channel including two channel ends and a mid-channel position formed generally between said two channel ends, and at least one channel end having a width which is greater than the width of said mid-channel position.

21. A cutting device as defined in claim 1, wherein said guide hook includes a front face, said front face including two side sections and a central section and at least one of said side sections sloping inwardly from said central section.

22. A cutting device as defined in claim 1, wherein said guide hook includes an inner face, said inner face including two side sections and a central section, and at least one of said side sections sloping inwardly from said central section.

23. A cutting device as defined in claim 1, wherein said guide hook includes a top face, said top face including two side sections and a central section, and at least one of said side sections sloping downwardly from said central section.

24. A cutting device as defined in claim 1, wherein said guide lug is rotatably connected to said front wall of said guide shoe.

25. A cutting device as defined in claim 24, wherein said guide lug is secured in a sleeve of said front wall by a pin.

26. A cutting device as defined in claim 1, wherein said bolt hole in said coupling sleeve does not extend completely through said from wall of said guide shoe.

27. A cutting device as defined in claim 1, wherein said guide shoe connector provides for transverse rotation of said guide shoe relative to the longitudinal axis of said positioning arm.

28. A cutting device as defined in claim 1, wherein said coupling sleeve being partially positioned in the interior of said guide shoe and having an opening in said top side of said guide shoe, said coupling sleeve having a mortise type pocket adapted to telescopically receive at least a portion of said positioning arm.

29. A cutting device as defined in claim 1, wherein said bolt holes of said back and front sides having substantially the same diameter.

30. A cutting device as defined in claim 1, wherein a bottom side of said coupling sleeve being adapted to receive a portion of said positioning arm, said bottom side of said coupling sleeve extending through said bottom side of said guide shoe.

31. A cutting device as defined in claim 30, wherein said bottom side positioned generally centrally in said bottom side of said guide shoe.

32. A cutting device as defined in claim 30, wherein said positioning arm includes a convex arch-shaped portion that is receivable by said bottom side of said coupling device.

33. A cutting device as defined in claim 1, including at least one dirt egress opening.

34. A cutting device as defined in claim 33, wherein said at least one dirt egress opening traversing said side walls of said guide shoe.

35. A cutting device as defined in claim 34, wherein said at least one dirt egress opening intersects said coupling sleeve.

* * * * *